US007377317B2

(12) United States Patent
Radzinski et al.

(10) Patent No.: US 7,377,317 B2
(45) Date of Patent: May 27, 2008

(54) APPARATUS AND METHODS FOR LOGGING A WELL BOREHOLE WITH CONTROLLABLE ROTATING INSTRUMENTATION

(75) Inventors: Paul Radzinski, The Woodlands, TX (US); Kirk Towns, Houston, TX (US)

(73) Assignee: Precision Energy Services, Inc., Houston, TX (US)

( * ) Notice: Subject to any disclaimer, the term of this patent is extended or adjusted under 35 U.S.C. 154(b) by 100 days.

(21) Appl. No.: 11/279,293

(22) Filed: Apr. 11, 2006

(65) Prior Publication Data

US 2006/0225880 A1 Oct. 12, 2006

Related U.S. Application Data

(60) Provisional application No. 60/670,544, filed on Apr. 12, 2005.

(51) Int. Cl.
*E21B 47/00* (2006.01)
*E21B 47/01* (2006.01)

(52) U.S. Cl. ..... 166/250.01; 166/66

(58) Field of Classification Search ..... 166/254.2, 166/0, 41, 45, 50; 175/40, 45, 48, 50; 73/152.01–152.61
See application file for complete search history.

(56) References Cited

U.S. PATENT DOCUMENTS 3,982,431 A * 9/1976 Grosso et al. ..... 73/152.47
4,799,546 A * 1/1989 Hensley et al. ..... 166/254.2
6,247,542 B1 6/2001 Kruspe et al.
6,516,898 B1 * 2/2003 Krueger ..... 175/50
6,564,883 B2 * 5/2003 Fredericks et al. ..... 175/50

FOREIGN PATENT DOCUMENTS

GB 2419903 5/2006

* cited by examiner

*Primary Examiner*—Jennifer H Gay
*Assistant Examiner*—Cathleen R Hutchins
(74) *Attorney, Agent, or Firm*—Wong, Cabello, Lutsch, Rutherford & Brucculeri LLP

(57) ABSTRACT

Disclosed herein is a borehole conveyance system that is conveyed within the borehole by a tubular such as a drill string. The conveyance system integrates wireline type downhole instrumentation into drilling and drill string tripping operations that are typically performed in a borehole drilling operation. This increases the types of measurements that can be obtained during the drilling operation. Equipment costs and maintenance costs can thereby be reduced. Certain wireline type tools can be used during drilling operations to yield measurements superior to their LWD/MWD counterparts and to reduce operation costs. Other types of wireline tools can be used to obtain measurements not possible with LWD/MWD systems. The rotation of the tool conveyance system and instrumentation therein is optionally controllable with respect to the rotation of the drill string by a selective locking subassembly (SLS).

7 Claims, 5 Drawing Sheets

APPARATUS AND METHODS FOR LOGGING A WELL BOREHOLE WITH CONTROLLABLE ROTATING INSTRUMENTATION

CROSS-REFERENCE TO RELATED APPLICATION

This application claims priority under 35 U.S.C. § 119(e) to U.S. provisional patent application Ser. No. 60/670,544, filed Apr. 12, 2005, which is incorporated herein by reference in its entirety.

BACKGROUND OF THE INVENTION

1. Field of the Invention

This invention is directed toward apparatus and methods for conveying and operating analytical instrumentation within a well borehole. More specifically, the invention is directed toward measurements of parameters of interest such as borehole conditions and parameters of earth formation penetrated by the borehole. A tubular such as a drill string is preferably used to convey the required analytical instrumentation.

2. Background of the Art

Properties of borehole environs are of great importance in hydrocarbon production. These parameters of interest include parameters related to the borehole, parameters related to properties of formations penetrated by the borehole, and parameters associated with the drilling and the subsequent production from the borehole. Borehole parameters include temperature and pressure, borehole wall imaging, caliper, orientation and the like. Formation properties include density, porosity, acoustic velocity, resistivity, formation fluid type, formation imaging, pressure and permeability. Parameters associated with drilling include weight on bit, borehole inclination, borehole direction and the like.

Properties of borehole environs are typically obtained using two broad types or classes of geophysical technology. The first class is typically referred to as wireline technology, and the second class is typically referred to as "measurement-while-drilling" (MWD) or "logging-while-drilling" (LWD).

Using wireline technology, a downhole instrument comprising one or more sensors is conveyed along the borehole by means of a cable or "wireline" after the well has been drilled. The downhole instrument typically communicates with surface instrumentation via the wireline. Measures of borehole and formation parameters of interest are typically obtained in real time at the surface of the earth. These measurements are typically recorded as a function of depth within the borehole thereby forming a "log" of the measurements. Basic wireline technology has been expanded to other embodiments. As an example, the downhole instrument can be conveyed by a tubular such as coiled production tubing. As another example, downhole instrument is conveyed by a "slick line" which does not serve as a data and power conduit to the surface. As yet another example, the downhole instrument is conveyed by the circulating mud within the borehole. In embodiments in which the conveyance means does not also serve as a data conduit with the surface, measurements and corresponding depths are recorded within the tool, and subsequently retrieved at the surface to generate the desired log. These are commonly referred to as "memory" tools. All of the above embodiments of wireline technology share a common limitation in that they are used after the borehole has been drilled.

Using MWD or LWD technology, measurements of interest are typically made while the borehole is being drilled, or at least made during the drilling operation when the drill string is periodically removed or "tripped" to replace worn drill bits, wipe the borehole, ream the borehole, set intermediate strings of casing, and the like.

Both wireline and LWD/MWD technologies offer advantages and disadvantages which generally known in the art, and will mentioned only in the most general terms in this disclosure for purpose of brevity. Certain wireline measurements produce more accurate and precise measurements than their LWD/MWD counterparts. As an example, dipole shear acoustic logs are more suitable for wireline operation than for the acoustically "noisy" drilling operation. Certain LWD/MWD measurements yield more accurate and precise measurements than their wireline counterparts since they are made while the borehole is being drilled and before drilling fluid invades the penetrated formation in the immediate vicinity of the well borehole. As examples, certain types of shallow reading nuclear logs are often more suitable for LWD/MWD operation than for wireline operation. Certain wireline measurements employ articulating pads which directly contact the formation and which are deployed by arms extending from the main body of the wireline tool. Examples include certain types of borehole imaging and formation testing tools. Pad type measurements have previously not been incorporated in LWD/MWD systems, since LWD/MWD measurements are typically made while the measuring instrument is being rotating by the drill string. Stated another way, if the pad type instrument is locked to a rotating drill string, the pads and extension arms would be quickly sheared off by the rotating action of the drill string.

BRIEF SUMMARY OF THE INVENTION

Disclosed is a borehole conveyance system that is conveyed within the borehole by a tubular such as a drill string. The conveyance system integrates wireline type downhole instrumentation into drilling and drill string tripping operations that are typically performed in a borehole drilling operation. This increases the types of measurements that can be obtained during the drilling operation. Equipment costs and maintenance costs are often reduced. Certain wireline type tools can be used during drilling operations to yield measurements superior to their LWD/MWD counterparts and to reduce operation costs. Other types of wireline tools can be used to obtain measurements not possible with LWD/MWD systems. The rotation of the tool conveyance system and instrumentation therein is optionally controllable with respect to the rotation of the drill string by a selective locking subassembly (SLS).

BRIEF DESCRIPTION OF THE DRAWINGS

The disclosure can be understood with reference to the appended drawings.

DETAILED DESCRIPTION OF THE INVENTION

Figure 1:
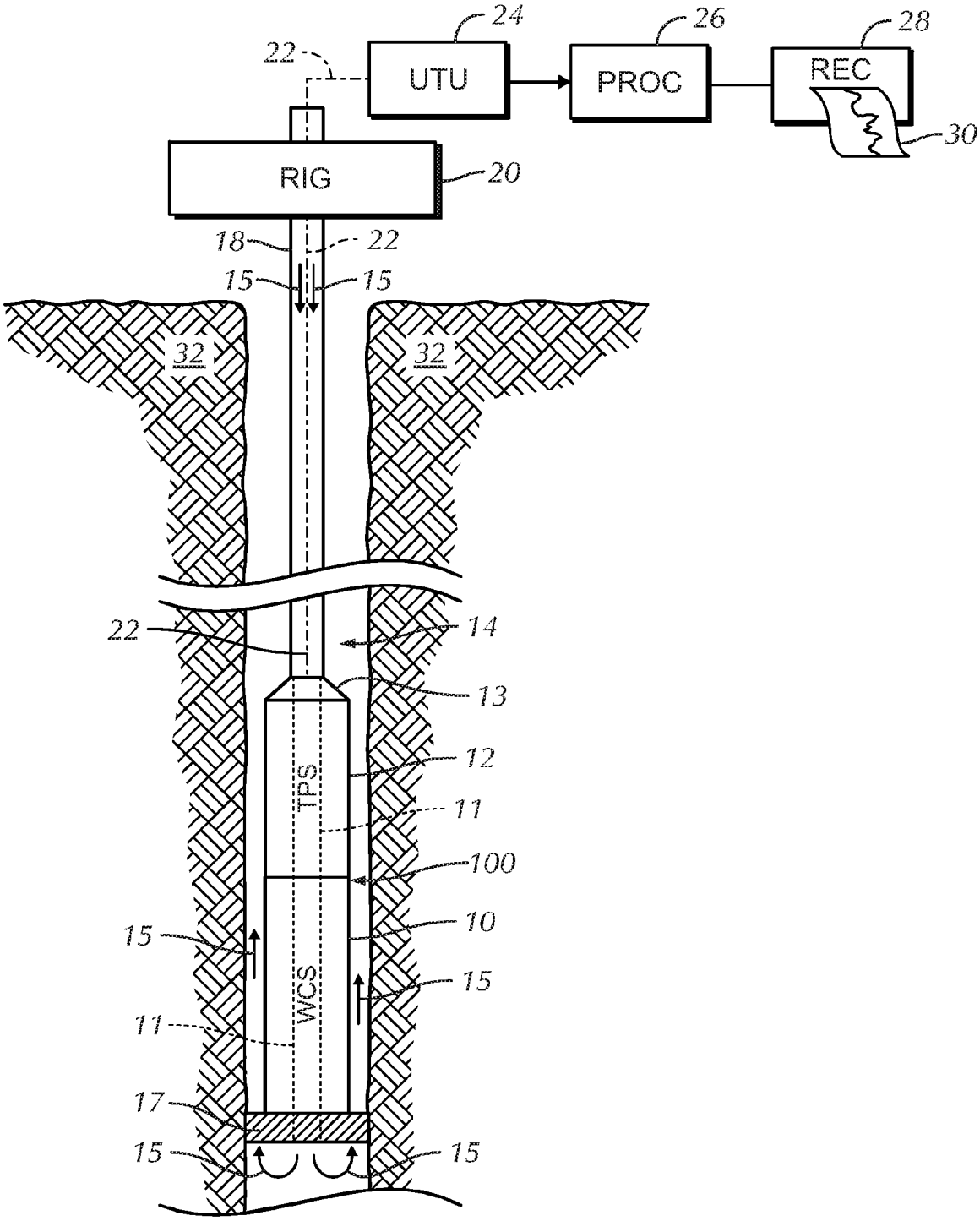
FIG. 1 illustrates a tool conveyance system for a wireline tool, with the tool conveyance system, comprising a telemetry-power sub "TPS" and a wireline conveyance sub "WCS", and deployed using a drill string in a borehole environment.

FIG. 1 illustrates a tool conveyance system 100 that is used to integrate wireline type downhole instrumentation into the tripping operations used periodically during a well borehole drilling operation. A wireline conveyance subsection (WCS) 10 is operationally attached to a telemetry-power subsection (TPS) 12 and suspended within a borehole 14 by means of a drill string 18 through a connector head 13. The components 10, 12 and 13 are often referred to as "elements" comprising the tool conveyance system 100. The borehole 14 penetrates earth formation 32. The lower end of WCS 10 is optionally connected to a wiper 17. The upper end of the drill string 18 is terminated at a rotary drilling rig 20, which is known in the art and illustrated conceptually. Drilling fluid or drilling "mud" is pumped down through the drill string 18 and through conduits in the TPS 12 and WCS 10, wherein the conduits are illustrated conceptually with the broken lines 11. Drilling mud exits the lower end of the WCS 10 and returns to the surface of the earth via the borehole 14. No mud flow exits any slits cut in the tool conveyance system 100. The flow of the drilling mud is illustrated conceptually by the arrows 15.

Still referring to FIG. 1, elements in the TPS 12 communicate with an uphole telemetry unit 24, as illustrated conceptually with the line 22. This link can include, but is not limited to, a mud-pulse telemetry system, an acoustic telemetry system, an electromagnetic telemetry system, or any suitable communication means known in the art. Downhole measurements are received by the uphole telemetry unit 24 and processed as required in a processor 26 to obtain a measure of a parameter of interest. The parameter of interest is recorded by a suitable electronic or "hard-copy" recording device 28, and preferably displayed as a function of depth at which it was measured as a log 30.

Figure 2A:
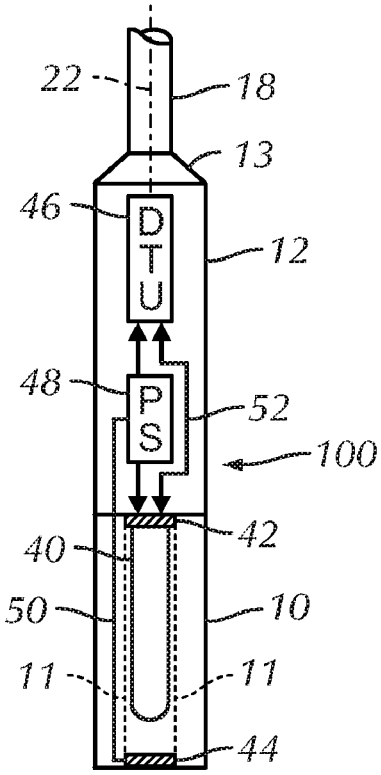
FIG. 2*a* shows the borehole wireline tool conveyance system with the wireline tool contained within.

FIG. 2*a* is a more detailed view of the WCS 10 and the TPS 12. A wireline tool 40 is shown deployed within the mud flow conduit illustrated by the broken lines 11. In the context of this disclosure, the term "wireline" tool includes tools operated with a wireline, tools operated with a slick line, and memory tools conveyed by drilling fluid or gravity.

Wireline logging systems have been used for decades, with the first system being operated in a borehole in the late 1920's. The tools typically vary in outside diameter from about 1.5 inches to over 4 inches. Lengths can vary from a few feet to 100 feet. Tool housings are typically fabricated to withstand pressures of over 10,000 pounds per square inch. Power is typically supplied from the surface of the earth via the wireline cable. Formation and borehole data, obtained by sensors in the downhole tool, can be telemetered to the surface for processing. Alternately, sensor data can be processed within the wireline tool, and "answers" telemetered to the surface. The patent literature abounds with wireline tool disclosures. U.S. Pat. Nos. 3,780,302, 4,424,444 and 4,002,904 disclose the basic apparatus and methods of a wireline logging system, and are entered herein by reference.

Again referring to FIG. 2*a*, the upper end of the wireline tool 40 is physically and electronically connected to an upper connector 42. The TPS 12 comprises a power supply 48 and a downhole telemetry unit 46. The power supply 48 supplies power to the wireline tool 40 through the connector 42, when configured as shown in FIG. 2*a*. The power supply 48 also provides power to the downhole telemetry unit 46, as illustrated by the functional arrow. The downhole telemetry unit 46 is operationally connected, through the upper connector 42, to the wireline tool 40 via the communication link represented conceptually by the line 52. The communication link 52 can be, but is not limited to, a hard-wire or alternately a "short-hop" electromagnetic communication link. As shown in FIG. 2*a*, a wireline tool can be conveyed into a well borehole 14 (see FIG. 1) using a tubular conveyance means such as a drill string 18. The WCS 10 tends to shield the wireline tool 40 from many of the harsh conditions encountered within the borehole 14. Furthermore, the tool 40 is in communication with the surface using the downhole and uphole telemetry units 46 and 24, respectively, over the communication link 22 which can be, but is not limited to, a mud pulse telemetry system, an acoustic telemetry system, or an electromagnetic telemetry system.

The outside diameter of the wireline tool 40 can be about 2.25 inches (5.72 centimeters) or less to fit within the conduit 11 of the WCS 10 and allow sufficient annular space for drilling fluid flow.

Figure 2B:
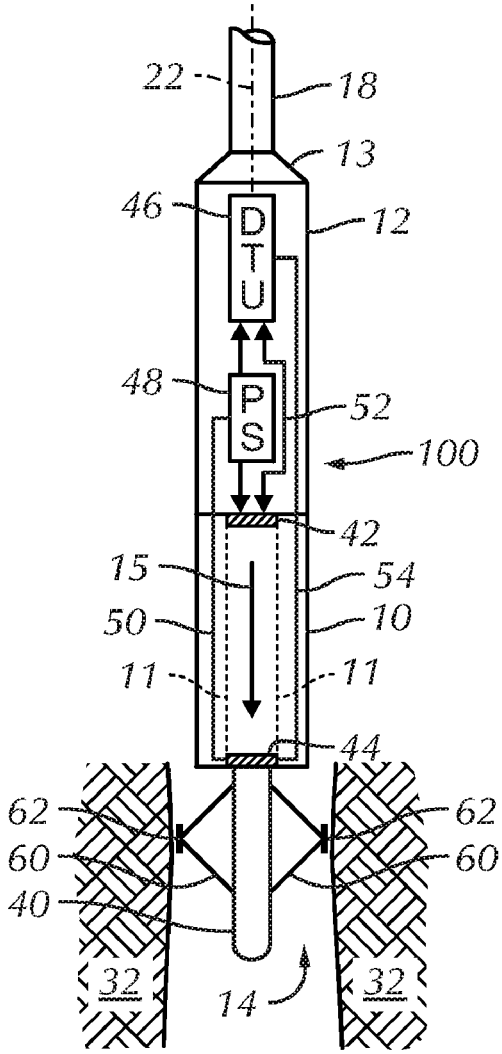
FIG. 2*b* shows the tool conveyance system with the wireline tool attached thereto and deployed in the borehole.

Once a desired depth is reached, the wireline tool 40 is deployed from the WCS 10. A signal is sent preferably from the surface via the telemetry link 22 physically releasing the tool 40 from the upper connector 42. Drilling fluid flow within the conduit 11 and represented by the arrow 15 pushes the tool 40 from the WCS 10 and into the borehole 14, as illustrated in FIG. 2*b*. If the tool 40 is a pad type tool, arms 60 are opened from the tool body deploying typically articulating pads 62 against or near the formation 32. Pad type tools include shallow investigating electromagnetic, nuclear and acoustic systems wherein the pads slide along the borehole wall. The deployed tool is physically and electrically connected to a lower connector 44, such as a wet connector. Electrical power is preferably supplied from the power supply 48 to the tool 40 by means of a wire 50 within the wall of the WCS 10. Alternately, power can be supplied by a coiled wire (not shown) extended inside the flow conduit (illustrated by the broken lines 11) from the upper connector 42 to the lower connector 44. Telemetric communication between the deployed tool 40 and the downhole telemetry unit 46 is preferably through the lower connector 44, and is illustrated conceptually with the line 54. Again, the communication link can include, but is not limited to, a hard wire or an electromagnetic short-hop system. Communication between the downhole telemetry unit 46 and the uphole telemetry unit 24 (see FIG. 1) is again via the previously discussed link 22. Again, it should be understood that the wireline tool 40 can be a non-pad device.

Well logging methodology comprises initially positioning the tool conveyance system 100 into the borehole 14 at a predetermined depth, and preferably in conjunction with some other type if interim drilling operation such as a wiper trip. This initial positioning occurs with the wireline tool 40 contained within the WCS 10, as shown in FIG. 2*a*. At the predetermined depth and preferably on command from the surface, the wireline tool is released from the upper connector 42, forced out of the WCS 10 by the flowing drilling fluid (arrow 15), and retained by the lower connector 44. This tool-deployed configuration is shown in FIG. 2*b*. The system 100 is preferably conveyed upward within the borehole by the drill string 18, and one or more parameters of interest are measured as a function of depth thereby forming the desired log or logs 30 (see FIG. 1). If the wireline tool 40 is a pad type formation testing tool, the system is stopped at a sample depth of interest, and pads 62 are forced against the wall of the borehole. A pressure sample or a fluid sample or both pressure and fluid samples are taken from the formation at that discrete depth. Alternately, formation pressure can be made, of formation pressure measurements and formation fluid sampled can both be acquired. The tool conveyance system 100 is subsequently moved and stopped at the next sample depth of interest, and the formation fluid sampling procedure is repeated.

The tool conveyance system 100 can be combined with an LWD/MWD system to enhance the performance of both technologies. As discussed previously, it is advantageous to use LWD/MWD technology to determine certain parameters of interest, and advantageous and sometimes necessary to use wireline technology to determine other parameters of interest. Certain types of LWD/MWD and wireline measurements are made most accurately during the drilling phase of the drilling operation. Other LWD/MWD measurements can be made with equal effectiveness during subsequent trips such as a wiper trip.

Configured as shown in FIGS. 2*a* and 2*b*, wireline conveyed logging can not be performed while drilling, and the tool conveyance system 100 is typically not be included in the drill string during actual drilling. Using this configuration, drilling LWD/MWD measurements and wireline conveyed measurements must, therefore, be made in separate runs. In order to accurately combine measurements made during two separate runs, the depths of each run must be accurately correlated over the entire logged interval.

Figure 3:
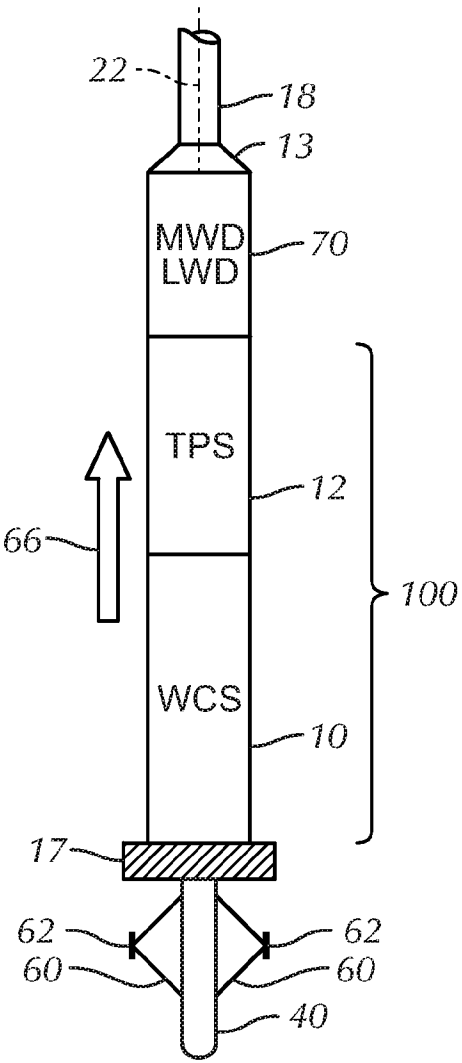
FIG. 3 shows a hybrid system with the tool conveyance system combined with a LWD/MWD instrument, wherein the wireline tool is deployed in the borehole.

A hybrid tool comprising the tool conveyance system 100 and a LWD/MWD subsection or "sub" 70 is shown in FIG. 3. As shown, the LWD/MWD sub 70 is operationally connected at the lower end to the TPS 12 and at the upper end to the connector head 13. The LWD/MWD sub 70 comprises one or more sensors (not shown). The hybrid tool is preferably used to depth correlate previously measured LWD/MWD data with measurements obtained with the tool conveyance system 100.

Operation of the hybrid system shown in FIG. 3 is illustrated with an example. Assume that neutron porosity and gamma ray LWD/MWD logs have been run previously while drilling the borehole. After completion of the LWD/MWD or "first" run, the drill string is removed from the borehole and the drill bit and motor or rotary steerable is removed. The tool conveyance system 100, comprising a gamma ray sensor and, as an example, a wireline formation tester, is added to the tool string below the LWD/MWD sub 70, as shown in FIG. 3. The tool string is lowered into the borehole, and the wireline tool 40 (comprising the gamma ray sensor and formation tester) is deployed as illustrated in FIG. 3. The tool string is moved up the borehole as indicated by the arrow 66 thereby forming a "second" run with the tools "sliding".

Both the wireline tool 40 and the LWD/MWD sub 70 measure gamma radiation as a function of depth thereby forming LWD/MWD and wireline gamma ray logs. It known in the art that multiple detectors are typically used in logging tools to form count rate ratios and thereby reduce the effects of the borehole. It is also known that additional borehole corrections, such as tool standoff corrections, are typically applied to these multiple detector logging tools. As an example, standoff corrections are applied to dual detector porosity and dual detector density systems. Standoff corrections for rotating dual detector tools typically differ from standoff corrections for wireline tools. The LWD/MWD neutron porosity measurement is preferably not repeated in the second run, since LWD/MWD borehole compensation techniques, including standoff, are typically based upon a rotating, rather than a sliding tool. Furthermore, washouts and drilling fluid invasion tends to be more prevalent during the second run. Stated another way, the neutron porosity measurement would typically be less accurate if measured during the second run, for reasons mentioned above.

The second run LWD/MWD gamma ray log may not show the exact magnitude of response as the "first run" LWD/MWD log, because factors discussed above in conjunction with the neutron log. Variations in the absolute readings tend to be less severe than for the neutron log. Furthermore, the second run gamma ray log shows the same depth correlatable bed boundary features as observed during the first run.

During the second run, the tool string is stopped at desired depths to allow multiple formation tests. Formation testing results, made with the wireline tool 40 during the second run, are then depth correlated with neutron porosity, made with the LWD/MWD sub 70 during the first run made while drilling, by using the gamma ray logs made during both runs as a means for depth correlation. All data are preferably telemetered to the surface via the telemetry link 22. Alternately, the data can be recorded and stored within the wireline tool for subsequent retrieval at the surface of the earth.

The tool conveyance system 100 can be combined with an LWD/MWD system to enhance the performance of both technologies using alternate configurations and methodology. FIG. 4*a* shows the LWD/MWD sub 70 operationally connected to the TPS sub 12, which is terminated at the lower end by a drill bit 72. One or more LWD/MWD measurements are made as the drill string 18 rotates and advances the borehole downward as indicated by the arrow 67. This will again be referred to as the "first run".

Figure 4B:
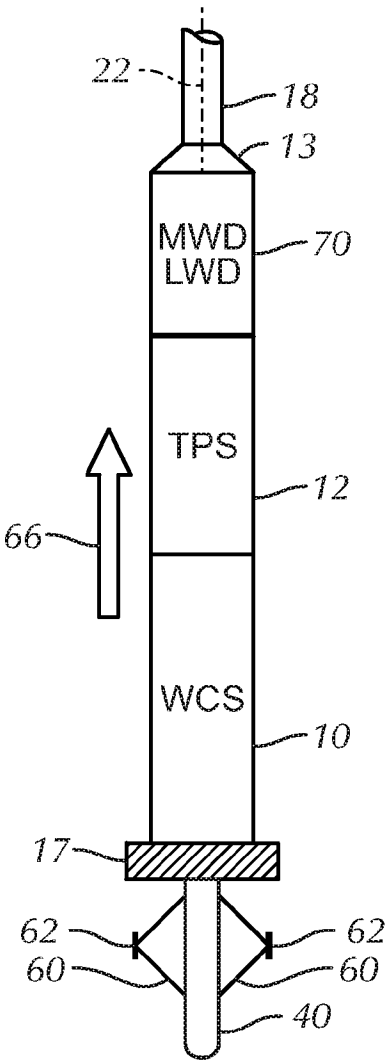
FIG. 4*b* shows LWD/MWD and TPS subassemblies in combination with the tool conveyance system.
Figure 4A:
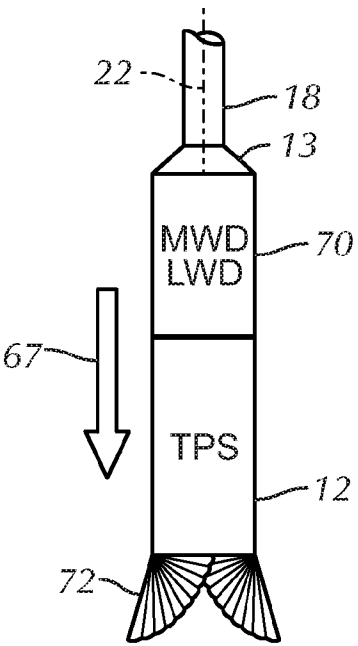
FIG. 4*a* shows a LWD/MWD subassembly combined with a telemetry and power subsection (TPS) of the tool conveyance system to form a LWD/MWD system for measuring parameters of interest while advancing the borehole.

During a second run of the drill string such as a wiper trip, the WCS 10 is added to the drill string along with a wiper 17, as shown in FIG. 4*b*. In this embodiment, the LWD/MWD sub 70 can utilize a dedicated telemetry system and power supplies. Alternately, the WCS 10 and LWD/MWD sub 70 can share the same power supply 52 and downhole telemetry unit 46 (see FIGS. 2*a* and 2*b*) contained in the TPS 12. The tool is lowered to the desired depth, the wireline tool 40 is deployed as previously discussed, and the tool string in moved up the borehole (as indicated by the arrow 66) using the drill string 18 and cooperating connector head 13. One or more wireline tool measurements along with at least one LWD/MWD correlation log are measured during this second run. The at least one LWD/MWD correlation log allows all wireline and LWD/MWD logs to be accurately correlated for depth, and for other parameters such as borehole fluids, over the full extent of the logged interval. Again, all measured data are preferably telemetered to the surface via the telemetry link 22. Alternately, the data can be recorded and stored within the borehole tool for subsequent retrieval at the surface of the earth.

It should be noted that the step of running at least one LWD/MWD correlation log can be omitted, and only a wireline log using the tool 40 can be run if the particular logging operation does not require a LWD/MWD log, or does not require LWD/MWD log and wireline log depth correlation.

It should also be noted that the downhole element discussed previously can contain a downhole processor thereby allowing some or all sensor responses to be processed downhole, and the "answers" are telemetered to the surface via the telemetry link 22 in order to conserve bandwidth.

Selective Locking Subassembly

Using the above embodiments, wireline type measurements with any type of pad type tool 40 are made with the drill string 18 not rotating. The non rotating drill string greatly increases the chance of the drill string and entire borehole assembly becoming lodged or "stuck" within the borehole. Operational problems such as this are minimized by the use of a selective locking subassembly (SLS) which controls rotational movement of the tool conveyance system 100 with respect to the drill string 18.

Figure 5B:
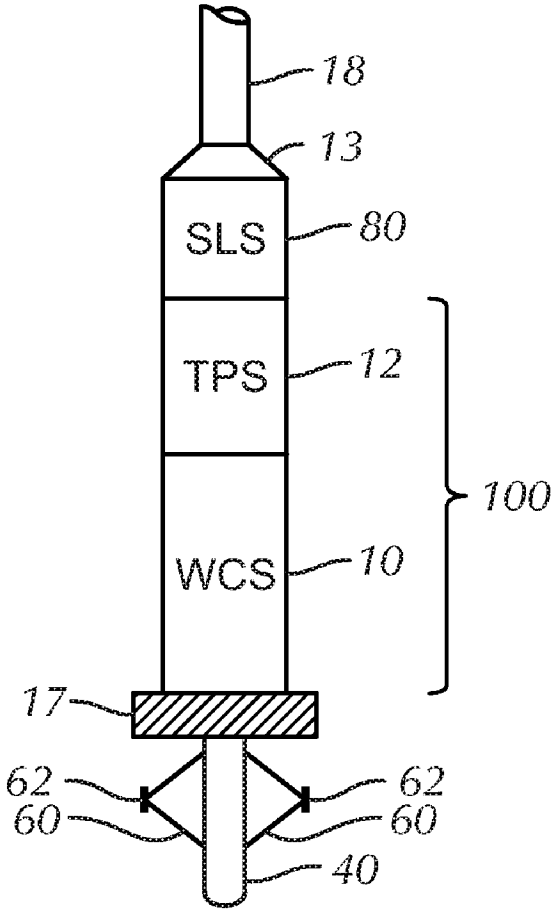
FIG. 5*b* shows a wireline tool deployed from the WCS element of the system shown in FIG. 5*a;*
Figure 5A:
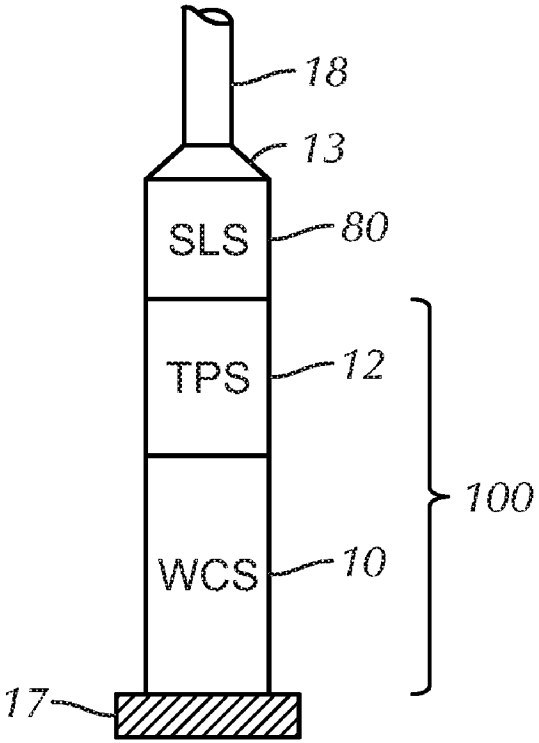
FIG. 5*a* shows a SLS disposed between a tool conveyance system and a drill string, wherein relative rotation between the borehole conveyance system and the drill string is controlled by the SLS.

FIG. 5*a* shows a SLS 80 disposed between the connector head 13 and the tool conveyance system 100. The TPS 12, WCS 10, and wiper 17 have been discussed previously. The SLS 80 can be a ratchet type mechanism with two functional settings that are determined by sequential first and second signal, preferably transmitted from the surface of the earth. At a first functional setting triggered by the first signal, the SLS 80 rotationally locks the tool conveyance system 100 to the drill string 18. At a second functional setting triggered by the second signal, the SLS 80 acts as a swivel, thereby allowing free rotational movement between the tool conveyance system 100 and drill string 18. The first setting will hereafter be referred to as the "locked" setting, and the second setting referred to as the "rotational" setting. The first and second signals are preferably pressures pulse supplied through the drilling fluid or drilling "mud" by operation of drilling fluid pumps. Alternately, acoustic, electromagnetic or other types of signals can be used to set the SLS 80.

FIG. 5*a* shows the wireline tool contained within the WCS 10 of the tool conveyance system 100. FIG. 5*b* shows the tool 40 deployed from the WCS 10, wherein the tool is a pad type tool as shown previously in FIG. 3. Operationally, the tool conveyance system 100 is lowered to a desired borehole depth in the configuration shown in FIG. 5*a*. It is preferred that the SLS 80 be in the locked setting. Once a desired borehole depth is reached, the tool 40 is deployed as shown in FIG. 5*b* by means previously discussed. A signal sets the SLS 80 in the rotational setting. The drill string 18 can, therefore, be rotated with respect to the conveyance assembly and deployed tool 40. Assume for purposes of discussion that the deployed tool 40 shown in FIG. 5*b* is a formation tester, which is stationary with respect to the wall of the borehole during formation testing. The drill string 18 can, however, be simultaneously rotated thereby reducing the chance of adverse operational problems such as drill string sticking.

Figure 6:
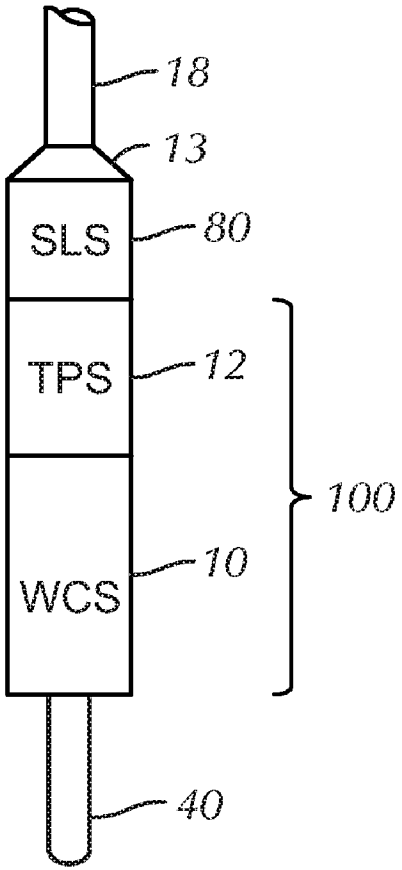
FIG. 6 shows a borehole assembly that includes a SLS thereby allowing a tool deployed from the tool conveyance system to be rotated relative to the drill string.

FIG. 6 shows an embodiment wherein a tool 40 is deployed from the wireline conveyance system 10. Assume for the purposes of discussion that the tool 40 is a wireline tool such as a borehole scanner, or even a small diameter non pad type LWD/MWD tool, that must be rotating to obtain a meaningful measurement. With the SLS 80 in the locked setting, the tool conveyance system 100 and deployed tool 40 can be rotated by the drill string 18. Operationally, this allows the rotating drill string 18 to axially slide along the axis of the borehole, while the tool 40 is simultaneously rotated, thereby yielding the rotating environment in which the example tool 40 is designed to operate. Assume next for purposes of discussion that the tool 40 is a wireline pad type tool. With the SLS 80 in the rotational setting, the drill string 18 can be rotated while the pad type tool either slides along the borehole wall, or is affixed to the borehole wall in the case of a wireline pad type formation tester.

Figure 7B:
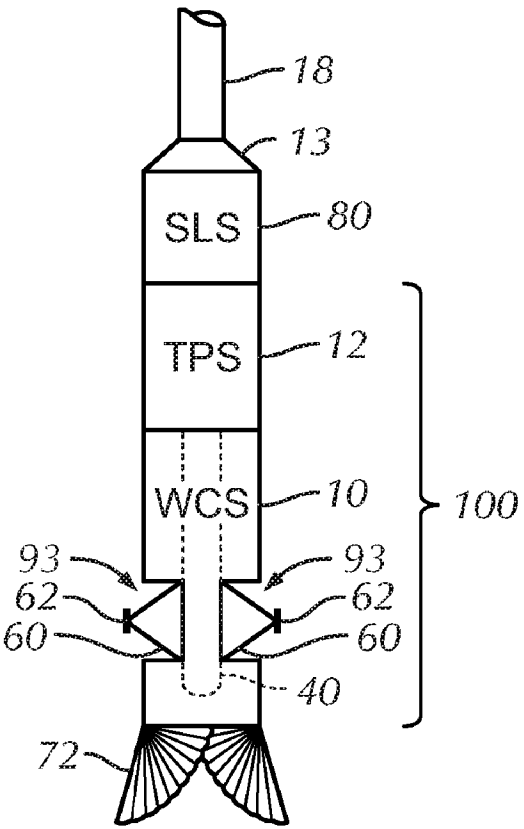
FIG. 7*b* shows side doors of the WCS element opened and wireline tool pads, such as formation tested pads, deployed through these openings, wherein the tool pads are stationary within the borehole during formation testing and the drill string can be simultaneously rotated during formation testing.
Figure 7A:
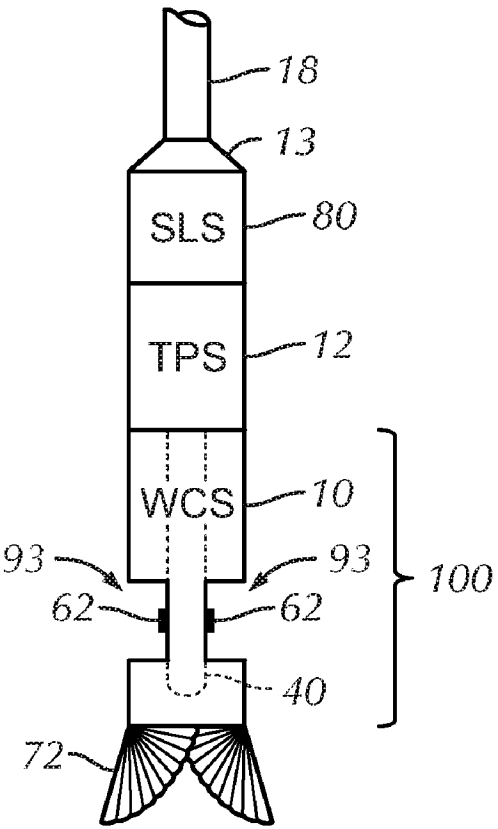
FIG. 7*a* shows a borehole assembly comprising a SLS and a tool conveyance system terminated by a drill bit (or alternately a reamer or open pipe), wherein the WCS element of the tool conveyance system comprises at least one side door, and wherein a wireline tool such as a formation tester is conveyed within the WCS element while borehole is being reamed or drilled.

FIG. 7*a* shows a SLS 80 disposed between a tool conveyance system 100 and the connector head 13. The WCS sub 10 of the tool conveyance system 100 is terminated at the lower end by a drill bit 72. Alternately, the lower end can be terminated by a reamer (not shown) or open pipe (not shown). The WCS sub 10 comprises at least one slot 93. Two slots 93 are shown in FIG. 7*a*. A pad type tool 40 is conveyed within the WCS 10, and is illustrated conceptually with broken lines. The tool 40 can be a formation tester tool. With the arms 60 (see FIG. 7*b*) closed and drawing the articulating pads 62 within the WCS 10, and with the SLS 80 in the locked setting, the drill string 18 and entire borehole assembly are rotated thereby reaming or advancing the borehole through the rotation action of the drill bit 72. The slots cooperate with appropriate seals with respect to the arms 60 and the mud flow conduit 11 (see FIG. 1) so that mud flow does not exit the slots.

Attention is next directed to FIG. 7*b*. At a desired depth within the borehole, a signal configures the SLS 80 in the rotational setting. The body of the tool 40 remains within the WCS 10. A tool command opens the arms 60 and cooperating pads 62 of the tool 40 so that the arms and pads extend through the slots 93. This exposes the pad portion of the tool 40 to the borehole environs. The articulating pads 62 are extended through the slots 93 by means of the arms 60 and forced against the borehole wall thereby preventing WCS 10 and the tool 40 from rotating during formation testing. The drill string 18 can, however, continue to rotate thereby minimizing operational problems, such as sticking, as previously discussed. In summary, the configurations shown in FIGS. 7*a* and 7*b* allows the borehole to be reamed or even drilled, with formation tests being made at selected depths without tripping the drill string. Furthermore, the drill string can be simultaneously rotated during formation testing.

Figure 8:
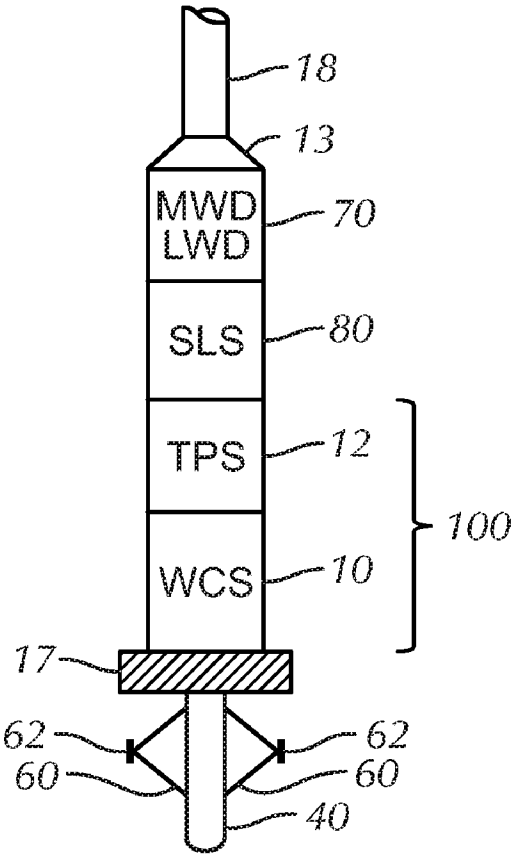
FIG. 8 shows a borehole assembly comprising a MWD/LWD sub, a SLS, and a conveyance assembly wherein a pad type tool deployed from the tool conveyance system is not rotating and is axially conveyed along the wall or the borehole, and wherein the MWD/LWD sub is simultaneously rotated as the borehole assembly is axially conveyed along the borehole.

FIG. 8 is similar to the embodiment shown in FIG. 3, but with a SLS 80 disposed between the tool conveyance system 100 and the MWD/LWD sub 70. With the SLS in the locked setting, the embodiment functions operationally as discussed in conjunction with FIG. 3. For purposes of discussion, assume that the tool 40 is a pad type device, such as a shallow investigating electromagnetic logging tool. The pads 62 are urged against the wall of the borehole by the arms 60, and the pads slide along the borehole wall as the tool 40 is conveyed axially along the borehole by the drill string 18. The SLS 80 is in the rotational setting. Unlike the embodiment shown in FIG. 3, the SLS 80 in the rotational setting permits the drill string 18 and the rigidly attached the MWD/LWD 70 sub to be simultaneously rotated. As discussed previously, MWD/LWD measurements are designed to be made with the instrumentation rotating. MWD/LWD measurements made with the embodiment shown in FIG. 8 can be, therefore, superior in accuracy and precision to those made with the non rotating embodiment of the MWD/LWD sub shown in FIG. 3, wherein the sub 70 only slides axially within the borehole.

In the embodiments illustrated in FIG. 5*a* through FIG. 8, it should be understood that the tool 40 can alternately be a MWD/LWD tool or a non pad type wireline tool.

Example of a Selective Locking Subassembly

The SLS 80 and operating signals can be embodied in a variety of forms. The following discloses major elements and functions of one such embodiment. One embodiment comprises of four major elements (not shown) which are a bearing section, a clutch section, a cycling mechanism, and a pressure indicator. The bearing section is preferably at the top of the SLS 80 to allow free rotation and support the required operational loads. Below the bearing section is the clutch mechanism, which locks the SLS housing to a free rotating drive shaft when configured in the "locked" setting. Directly below and cooperating with the clutch is the cycling mechanism, which allows the SLS to free rotate or be locked depending upon the drilling rig mud pump cycle. At the bottom of the SLS is the pressure indicator indicates the setting (locked or rotational) of the SLS.

The clutch is engaged and disengaged by the cycling mechanism. When the mud pumps are turned on, a pressure differential between the high pressure drilling fluid in the borehole and the lower pressure annulus (see FIG. 1) is formed. This acts across a shaft causing it to move down once the force is sufficient to overcome a spring. As the shaft moves downward, it picks up the clutch plate. The stroke of the shaft stops when a barrel cam mechanism stops the movement. The SLS is in the "rotational" setting. When the mud pumps are shut off, the shaft and clutch plate move back up powered by a return spring. Clutch teeth align, and the barrel cam cycles to a new position. When the pumps are off, the SLS is in the locked setting. When the mud pumps are again turned on, the shaft will begin to move. This time the barrel cam will stop the shaft from traveling far enough to pick up the clutch plate, and the SLS remains in the locked setting. When the mud pumps are once again shut off, the shaft returns and the setting ratcheting cycle starts again.

It should be understood that the above disclosed apparatus is but one means for obtaining controllable rotation between the drill string 18 and the tool conveyance system 100 and other borehole assembly elements. Other means yield comparable results. It is also again stated that signals used to obtain settings are not limited to pressure pulses, but can be electromagnetic, acoustic, mechanical and the like.

While the foregoing disclosure is directed toward the preferred embodiments, the scope of the invention is defined by the claims, which follow.

What is claimed is:

1. A tubular conveyed borehole system, the system comprising:

a MWD/LWD subsection operationally attached to a tubular;

a tool conveyance system;

a selective locking subsection operationally disposed between said MWD/LWD subsection and said tool conveyance system; and a wireline tool that is conveyed within and deployed from said tool conveyance system; wherein relative rotation between said MWD/LWD subsection and said wireline tool is controlled by a functional setting of said selective locking subsection.

2. The system of claim 1 wherein said tool conveyance system further comprises:

a downhole telemetry unit; and a wireline carrier subsection; wherein said wireline tool communicates with said downhole telemetry unit with said wireline tool contained within said wireline carrier subsection, and with said wireline tool deployed out of said wireline carrier subsection.

3. The system of claim 2 wherein said selective locking subsection:

prevents relative rotation between said wireline tool and said tubular upon receipt of a first signal; and allows relative rotation between said wireline tool and said tubular upon receipt of a second signal.

4. The system of claim 3 wherein said first and second signals are pressure pulses.

5. A method for measuring multiple parameters of interest with a tubular conveyed borehole system, the method comprising:

operationally attaching a MWD/LWD subsection to a tubular;

providing a tool conveyance system;

operationally disposing a selective locking subsection between said MWD/LWD subsection and said tool conveyance system;

providing a wireline tool;

with said selective locking subsection in a locked setting, with said wireline tool contained within said tool conveyance system, and with said tubular rotating and moving axially along said borehole, obtaining a first measure of said parameters of interest from response of said MWD/LWD subsection; and with said wireline tool deployed into said borehole from said conveyance system, with said selective locking subsection in a rotational setting, and with said tubular rotating and axially stationary within said borehole, obtaining a second measure of said parameters of interest from said wireline tool and a third measure of said parameters of interest from said axially stationary and rotating MWD/LWD subsection.

6. The method of claim 5 wherein said wireline tool is a formation tester and is axially fixed with respect to said borehole.

7. The method of claim 5 wherein said wireline tool is a shallow investigating pad type device, and said wireline tool is conveyed axially along said borehole.

* * * * *